United States Patent [19]

Aoki et al.

[11] 4,401,079

[45] Aug. 30, 1983

[54] ELECTRONICALLY CONTROLLED FUEL INJECTION METHOD AND APPARATUS

[75] Inventors: Keiji Aoki; Shinji Ikeda, both of Susono, Japan

[73] Assignee: Toyota Jidosha Kogyo Kabushiki Kaisha, Toyota, Japan

[21] Appl. No.: 213,334

[22] Filed: Dec. 5, 1980

[30] Foreign Application Priority Data

Sep. 5, 1980 [JP] Japan ..... 55-122295

[51] Int. Cl.[3] ..... F02B 3/00; F02M 7/00

[52] U.S. Cl. ..... 123/435; 123/425; 123/179 G; 123/179 L

[58] Field of Search ..... 123/425, 435, 436, 440, 123/179 G, 179 L

[56] References Cited

U.S. PATENT DOCUMENTS

| | | | |
|---|---|---|---|
| 2,592,284 | 4/1952 | Hopkins | 123/425 |
| 2,604,756 | 7/1952 | Greenland | 123/425 |
| 2,628,606 | 2/1953 | Draper | 123/436 |
| 4,026,251 | 5/1977 | Schweitzer | 123/436 |
| 4,216,750 | 8/1980 | Kobayashi | 123/435 |
| 4,232,643 | 11/1980 | Leshner | 123/436 |
| 4,242,995 | 1/1981 | Schramm | 123/425 |
| 4,271,798 | 6/1981 | Kato | 123/425 |
| 4,271,798 | 6/1981 | Seitz | 123/436 |
| 4,321,902 | 3/1982 | Stoltman | 123/435 |
| 4,327,689 | 5/1982 | Rachel | 123/436 |

*Primary Examiner*—Ronald B. Cox

*Attorney, Agent, or Firm*—Cushman, Darby & Cushman

[57] ABSTRACT

An electronically controlled, fuel injection method and apparatus, wherein fuel is supplied by an electromagnetic fuel injection valve into an intake system. The rate of fuel injection when the engine is cold is increased or decreased in relation to a difference between a detected engine torque and a predetermined optimum torque. Consequently, good operational performance of the engine at low engine temperature is ensured, irrespective of variations in ambient factors such as atmospheric pressure, etc. and variations in engine characteristics.

10 Claims, 6 Drawing Figures

ELECTRONICALLY CONTROLLED FUEL INJECTION METHOD AND APPARATUS

BACKGROUND OF THE INVENTION

1. Field of the Invention

This invention relates to an electronically controlled, fuel injection method and apparatus, wherein a fuel injection valve in an intake system is operated by electric signals, thereby controlling the rate of fuel being injected into a combustion chamber.

2. Description of the Prior Art

In a known electronically controlled, fuel injection method, it has been customary to determine the rate of fuel injection at low engine temperatures, in relation to the temperature of engine cooling water, and not employing any feedback signal from an air-fuel ratio sensor. For this reason, variations in ambient factors, such as atmospheric pressure, humidity, etc. and variations in characteristics of an individual engine have been responsible for impairing the operational performance of an engine at low operating temperatures.

SUMMARY OF THE INVENTION

It is an object of the present invention to provide an electronically controlled, fuel injection method and apparatus, wherein good operational performance at low engine temperatures is usually maintained, irrespective of variations in ambient factors and variations in characteristics of an individual engine.

To attain the above object, according to the electronically controlled, fuel injection method and apparatus of the present invention, the rate at which fuel is injected at low engine temperatures is increased or low temperature running of an engine is increased or decreased in relation to a difference between an engine torque detected and a predetermined optimum torque. Thus, at low engine temperatures, feedback control is effected employing the output torque of the engine, with the result that the engine operates well, irrespective of variations ambient factors and variations in characteristics of an individual engine.

Preferably, torque is obtained by integrating pressure P in the combustion chamber as a function of an angle C of the crank shaft, namely, by calculating the formula $$Pi = \phi P \cdot \frac{dV}{dC} \cdot dC,$$

wherein P is representative of a pressure in the combustion chamber, and dV a small change of a volume V of the combustion chamber for a small change dC in a crank shaft angle C.

Preferably, the rate at which fuel is injected at low engine temperatures is increased or decreased in relation to a difference between T and an optimum torque To, the value T being obtained by calculating the formula $T = k_2 \cdot (Pi - Pf - Pp)$, wherein Pf is representative of the frictional average effective pressure obtained by substituting a loss of an engine in its entirety by a combustion chamber pressure; Pp an average pumping effective pressure, and $k_2$ a predetermined constant.

Since engine torque fluctuates every cycle, the rate at which fuel is injected at low temperatures is preferably increased or decreased in relation to a difference between a mean value of torque detected at every 5 cycles and an optimum torque.

DESCRIPTION OF THE PREFERRED EMBODIMENTS

Figure 1:
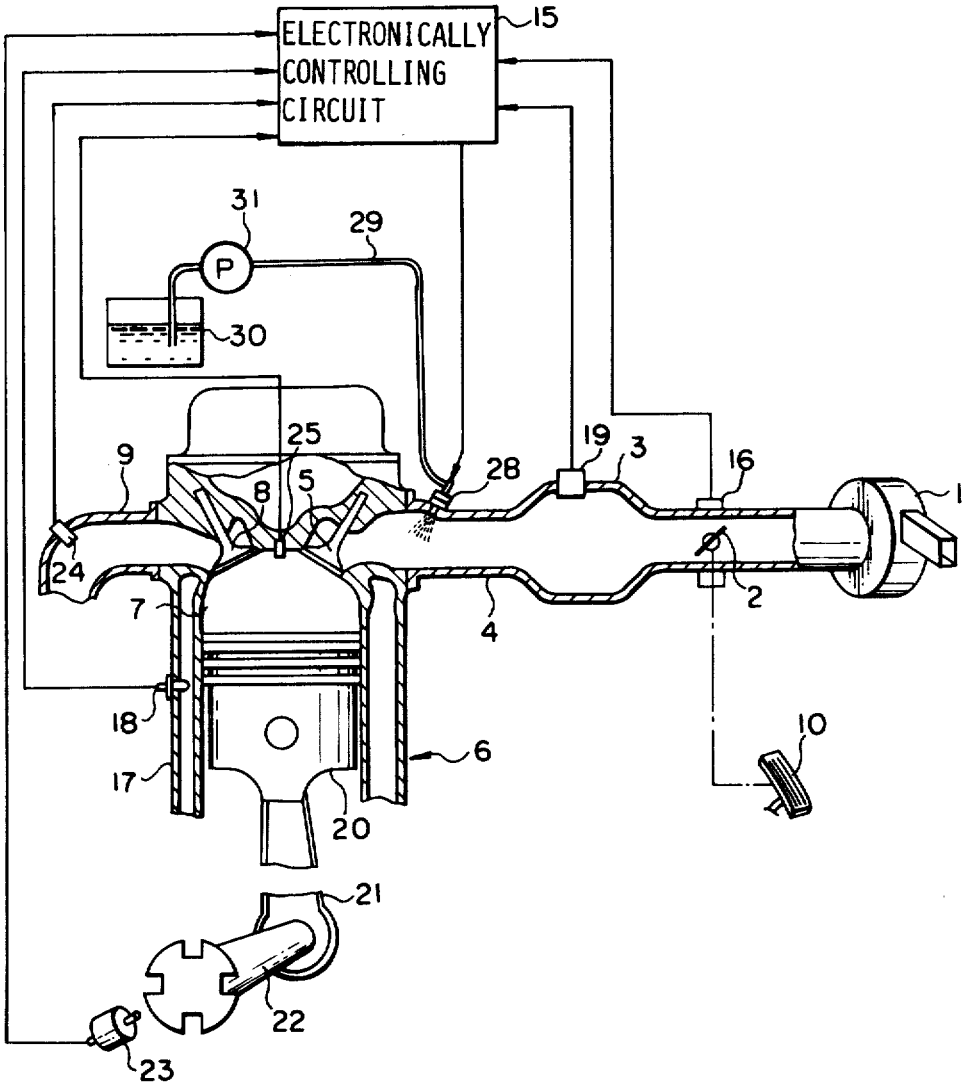
FIG. 1 is a schematic view of an electronically controlled, fuel injection device to which the method of the present invention is to be applied.

Description will start with a summary of an electronically controlled, fuel injection method and apparatus. Referring to FIG. 1, intake air is drawn under suction from an air cleaner 1 and supplied via a surge tank 3, an intake pipe 4 and an intake valve 5 into a combustion chamber 7 of an engine body 6. The flow rate of intake air is controlled by a throttle valve 2 interconnected to an acceleration pedal 10 in a driver's room. The mixture charge burnt in the combustion chamber 7 is released in the form of exhaust gases via an exhaust valve 8 and an exhaust manifold 9 to the atmosphere. A fuel injection valve 28 is provided in the intake manifold 4 in a manner to face each combustion chamber. An electronic control circuit 15 includes a microprocessor serving as a computation portion, ROM,RAM and filters. The electronically controlling circuit 15 receives input signals from a throttle switch 16 for detecting the fully closed throttle valve 2, a water temperature sensor 18 attached to a water jacket 17 in the engine body 6, a vacuum sensor 19 attached to the surge tank 3, a crank-angle sensor 23 for detecting rotation of a crank shaft 22 connected by way of a connecting rod 21 to a piston 20, a known air-fuel ratio sensor 24 provided in the exhaust manifold 9 and acting as an oxygen-concentration sensor, and a pressure sensor 25 for detecting a pressure in the combustion chamber 7. Control circuit 15 transmits pulse signals related to the rate at which fuel is injected by the fuel injection valve 28 provided in the vicinity of an intake port. Fuel is pumped by a fuel pump 31 from a fuel tank 30 and supplied by way of a fuel passage 29 into the fuel injection valve 28. The microprocessor in the electronical control circuit 15 computes the rate at which fuel should be injected according to input signals from the intake-pipe pressure sensor 19, etc., in synchronism with the input signal from the crank-angle sensor 23.

Figure 2:
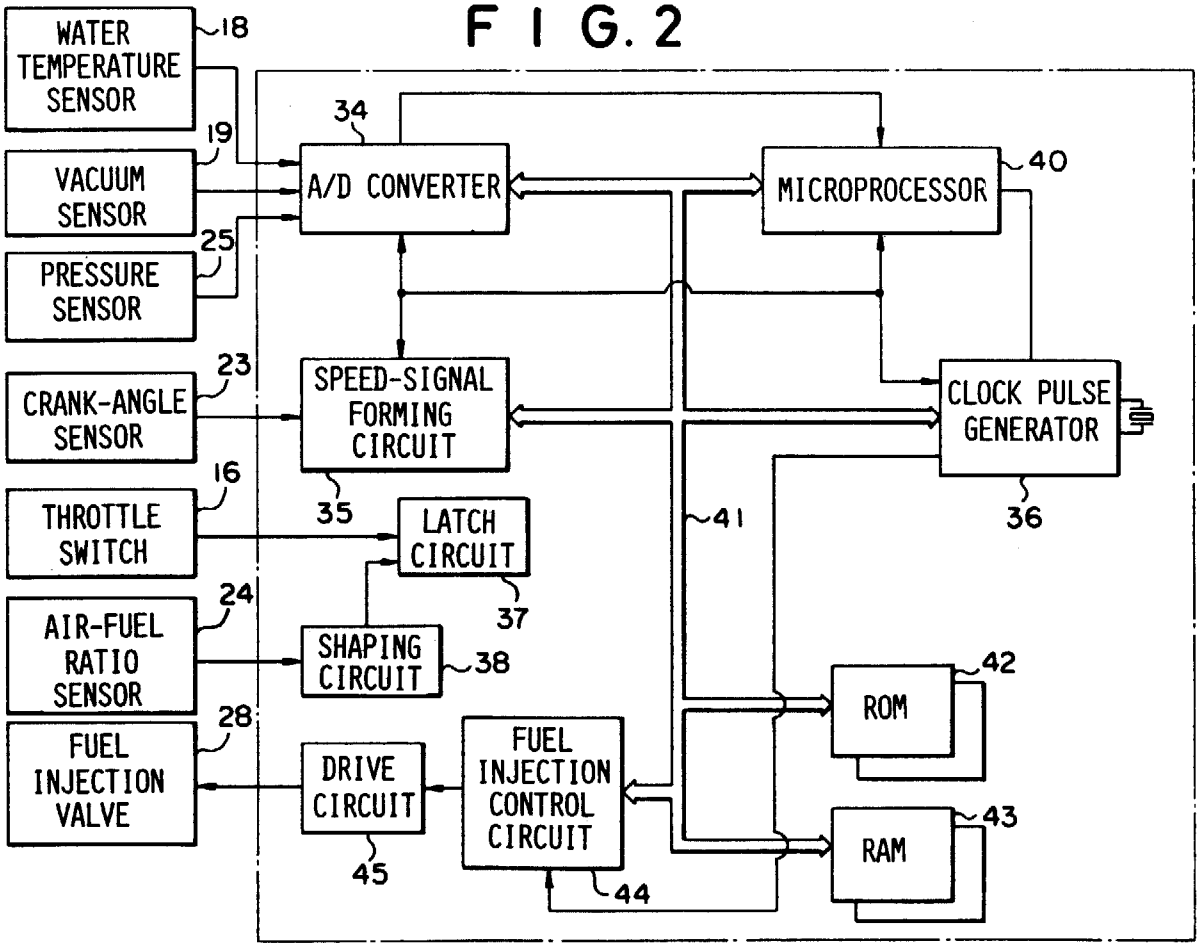
FIG. 2 is a block diagram of an electronically controlling circuit of FIG. 1.

FIG. 2 is a block diagram of the electronical control circuit 15. The output of the water-temperature sensor 18, the vacuum sensor 19 and the pressure sensor 29 are fed to an A/D converter 34, for being converted into digital signals. A speed-signal forming circuit 35 includes a gate adapted to open and close by a pulse from the crank-angle sensor 23, and a counter for counting clock pulses transmitted via the gate from a clock pulse generator 36. A value inversely proportional to the running speed of the engine is generated as the counter output. The output of the throttle switch 16 is temporarily stored in a latch circuit 37, and the output of the air-fuel ratio sensor 24 is shaped in a shaping circuit 38 and transmitted to the latch circuit 37. The microprocessor 40 is connected via bus 41 to ROM 42, RAM 43 and other blocks 34,35 and 37, and computes a rate at which fuel should be injected according to a predetermined program. Values corresponding to a fuel injection time thus computed are stored in a fuel-injection control circuit 44 and subtracted one by one from a predetermined time in response to clock pulses to thereby form pulses at the output terminal of the fuel-injection control circuit 44 until the value becomes zero. The pulses thus formed are transmitted from the circuit 44 via a drive circuit 45 to the fuel injection valve 28.

Figure 3:
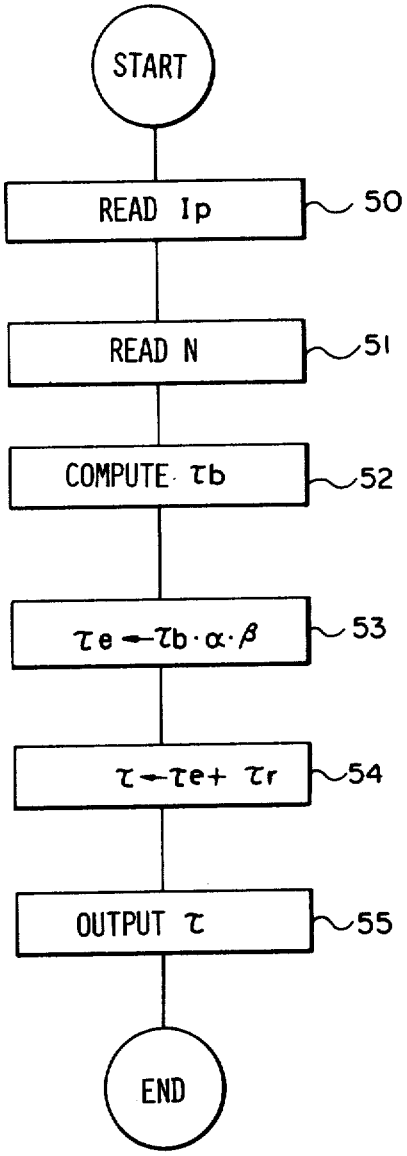
FIG. 3 is a flow chart of a computation program of a fuel injection time after termination of the warming-up of an engine.

FIG. 3 is a flow chart of a program for calculating a fuel injection time when the engine is at normal operating temperature, namely, after termination of the warming-up of an engine. Data on the intake pipe negative pressure manifold (vacuum) Ip and the running speed of an engine N which have been stored in RAM 43 are read in the steps 50 and 51, and a basic injection time $\tau b$ is obtained at the step 52, on the basis of these data. The values of $\tau b$ are mapped using P and $I_p$ as parameters, and stored beforehand in a ROM. In calculating $\tau b$, a known interpolating calculation is adopted. At the step 53, an effective injection time $\tau b$ is determined according to the formula $\tau e = \tau b \cdot \alpha \cdot \beta$ on the basis of a correction constant $\alpha$ based on a feedback signal from the air-fuel ratio sensor 24, an other correction constant $\beta$ and $\tau b$. At the step 54, a final injection time $\tau = \tau e + \tau r$ is calculated on the basis of the effective injection time $\tau e$, and an ineffective injection time $\tau r$ of the fuel injection valve 28, and $\tau$ is transmitted to the fuel injection control circuit 44 at the step 55.

Figure 4:
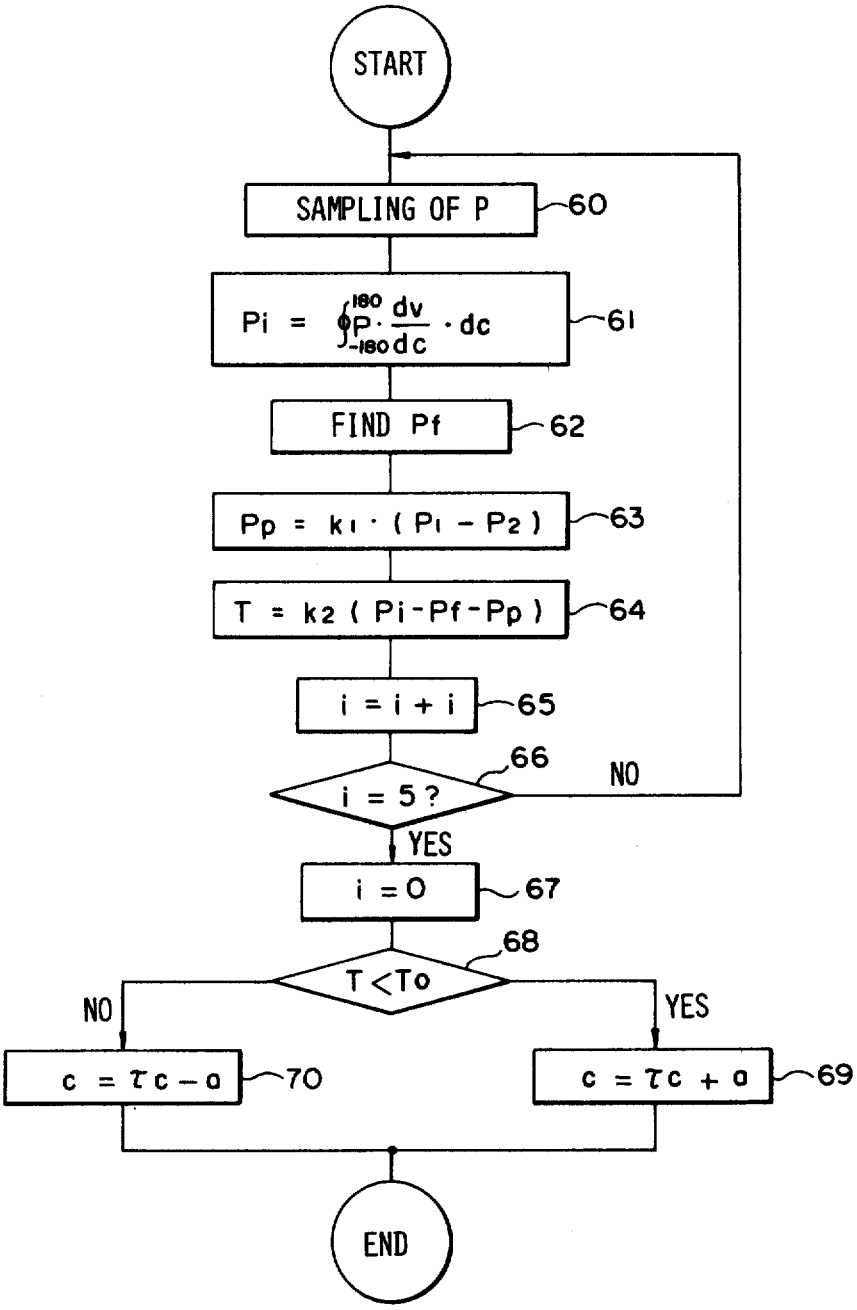
FIG. 4 is a flow chart of a computation program of a fuel injection time according to an embodiment of the present invention.
Figure 5:
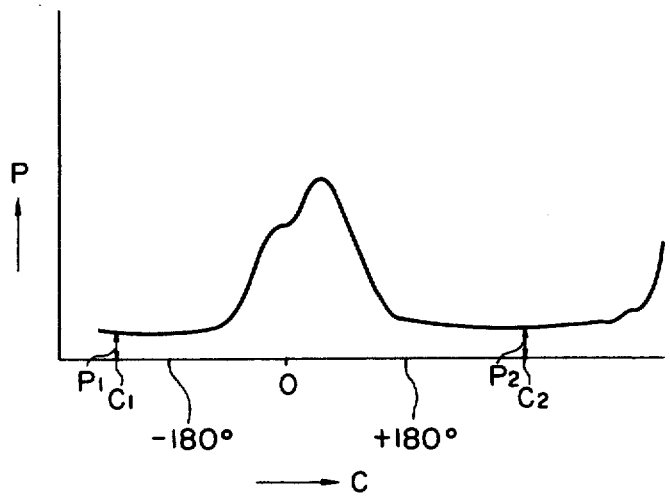
FIG. 5 is a graph indicating a change of a combustion chamber pressure which takes place every cycle of an engine; and, FIG. 6 is a graph indicating the relationship between an indicated mean effective pressure and a crankshaft torque, which has been measured in tests.

The manner of calculating of the fuel injection time at low engine temperatures will now be described in conjunction with the flow chart of FIG. 4. At low engine temperatures, no feedback signal representing an air fuel ratio is employed. FIG. 5 indicates a change of pressure in the combustion chamber 7 at each cycle of an engine. In FIG. 5, the abscissa indicates a crank angle C, wherein C=0 at the top dead center on the compression stroke, and the ordinate indicates a pressure P in the combustion chamber.

At the step 60, the sampling of the combustion chamber pressure P is conducted. As is apparent from FIG. 5, the combustion chamber pressure P during the intake stroke as well as the exhaust stroke is substantially constant. Since the amount of memory is typically limited, the sampling of the combustion chamber pressure P during the intake stroke and exhaust stroke is conducted only at one point (at the crank-angle C1 and C2, respectively), and at every 3° in crank-shaft angle in the range of ±180° of the top dead center on the compression stroke. On and after the step 60, the sampling is conducted for a duration during which there is a large sampling interval, namely, during the exhaust stroke or the intake stroke of an engine. At the step 62, the combustion chamber pressure P at each cycle is integrated by the formula:

$$Pi = \phi P \cdot \frac{dV}{dC} \cdot dC,$$

wherein dV is a small change of a volume V in the combustion chamber 7 with a small change dC in a crank angle C, and P is a function of C. Friction average effective pressure Pf given by substituting the loss of an engine in its entirety for the combustion chamber pressure is a function of the running speed N of an engine, and stored beforehand in ROM 42 in the form of the primary dimension map of N. In calculating Pf, interpolating calculation is employed. At the step 63, the pumping means effective pressure Pp is calculated. The pumping means effective pressure Pp is calculated according to the formula $Pp = k_1 \cdot (P1 - P2)$ on the basis of the combustion chamber pressures P1 and P2 at the crank angles C1 and C2, and a constant $k_1$. At the step 64, an output torque T is calculated. The output torque T is obtained according to the formular $T = k_2 \cdot (Pi - Pf - Pp)$ by using a constant $k_2$. At the step 65, "i+1" makes a new "i". "i" indicates which cycle of the engine is. Since the output torque T more or less fluctuates at every cycle, a mean output torque of 5 cycles is taken. At the step 66, whether or not i=5 is discriminated. If the answer is "YES", then the program proceeds on the step 67, and if "NO", the program is returned to the step 60. At the step 67, i=0.

Figure 6:
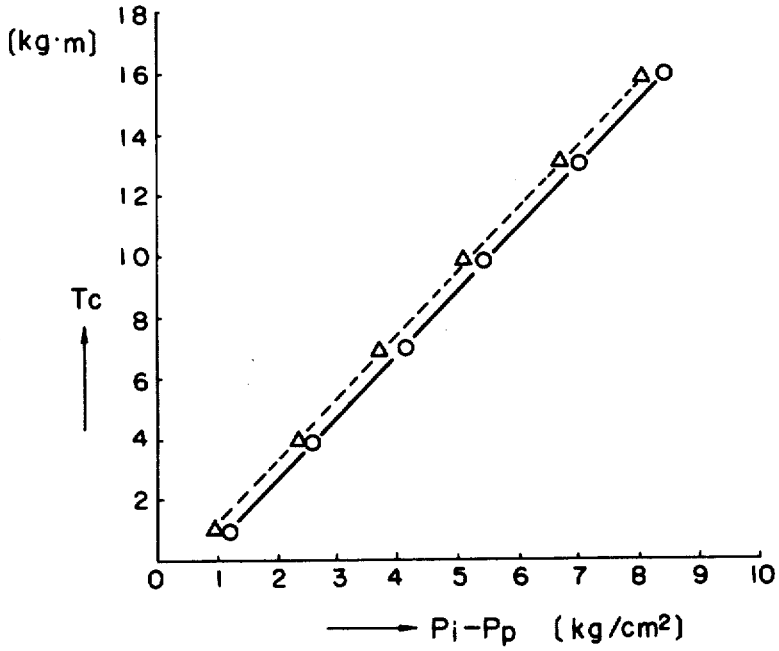

FIG. 6 is a graph indicating the relationship between the indicated means effective pressure Pi−Pp and the crank-shaft torque Tc, wherein circle (○) and triangle (Δ) marks indicate values measured when a sampling interval is respectively at 1° and 3° in the crank shaft angle and the value measured is a means value of 5 cycles. From this it is seen that there is little or no difference between the sampling interval of 3° and the sampling interval of 1°. This clearly shows that the sampling interval of 3° shown in the embodiment is practical. At the step 68, whether or not T<To is discriminated. If the answer is "YES", the program proceeds on the step 69, and if the answer is "NO", the program proceeds on the step 70. To is representative of an optimum torque. At the step 69, a is added to the former fuel injection time $\tau c$, for calculation of a fuel injection time $\tau c$ of this time, wherein a is a predetermined value of a positive number. Consequently, a rate of fuel being injected greatly increases, thus increasing the engine torque. At the step 70, a value obtained by subtracting a from the former fuel injection time $\tau c$ ($\tau c - a$) is deemed as a fuel injection time of this time. Consequently, a rate of fuel being injected decreases, thus reducing the engine torque.

Thus, a rate of fuel being injected at the low temperature running of an engine is increased or decreased in association with a difference between the engine torque detected and the predetermined optimum torque, with the result that a good operational performance of the engine is ensured, irrespective of ambient factors and a variation in characteristics of an individual engine.

What is claimed is:

1. A method of electronically controlling the rate of fuel being injected at low engine temperatures into an engine having a combustion chamber and a crank-shaft comprising the steps of:

(a) monitoring a pressure P in said combustion chamber;

(b) determining said P at a plurality of predetermined intervals during compression and explosion strokes from 180° before top dead center to 180° after top dead center;

(c) generating, in response to said determining step, an integrated pressure value Pi related to the integral of the product of P and the incremental change in combustion chamber volume per incremental change in crank-shaft angle over the range of crank-shaft angles from 180° before top dead center to 180° after top dead center during the compression and explosion strokes;

(d) generating a pumping means effective pressure value $P_p$ related to the difference between combustion chamber pressures during an intake stroke and an exhaust stroke of said engine;

(e) generating a torque value T related to said Pi less Pf and said $P_p$ where Pf is related to a frictional average effective pressure; and (f) adjusting said fuel injection rate so that T approaches a predetermined optimum torque, said steps (d), (e) and (f) occurring during one of an exhaust stroke and an intake stroke of said engine, said steps (c), (d) and (e) being performed by a microcomputer.

2. Apparatus for electronically controlling the rate of fuel being injected at low engine temperatures into an engine having a combustion chamber and a crank-shaft comprising:

means for monitoring a pressure P in said combustion chamber;

microcomputer processing means for (1) determining said P at a plurality of predetermined intervals during compression and explosion strokes from 180° before top dead center to 180° after top dead center and during each intake stroke and exhaust stroke, (2) generating, in response to said determining step, an integrated pressure value Pi related to the integral of the product of P and the incremental change in combustion chamber volume per incremental change in crank-shaft angle over the range of crank-shaft angles from 180° before top dead center to 180° after top dead center during the compression and explosion strokes, (3) generating a pumping means effective pressure value $P_p$ related to the difference between combustion chamber pressures during an intake stroke and an exhaust stroke of said engine, (4) generating a torque value T related to said Pi less Pf and said $P_p$ where Pf is related to a frictional average effective pressure, and (5) determining the amount by which said fuel injection rate should be adjusted so that T approaches a predetermined optimum torque, said microcomputer processing means functions (3), (4) and (5) occurring during one of an exhaust stroke and an intake stroke of said engine; and means, responsive to said microcomputer processing means for adjusting said fuel injection rate.

3. A method as defined in claim 1, wherein said step (b) includes the step of determining P during a compression stroke and an explosion stroke at every change through a predetermined angle of the crank-shaft.

4. A method as defined in claim 3, wherein said step (a) includes the step of determining P only a single point respectively during an intake stroke and an exhaust stroke of said engine.

5. A method as defined in claim 1, wherein said step (f) includes the step of adjusting said fuel injection rate so that a mean torque of said T averaged over 5 cycles approaches said optimum torque.

6. A method as defined in claim 3, wherein said predetermined angle is 3°.

7. Apparatus as in claim 2 wherein said microcomputer processing means determines said P during said compression and explosion strokes each time said crank-shaft rotates a predetermined angle.

8. Apparatus as in claim 7 wherein said predetermined angle is 3°.

9. Apparatus as in claim 2 wherein said microcomputer processing means determines said P only once during each intake stroke and each exhaust stroke.

10. Apparatus as in claim 2 wherein said microcomputer processing means averages said T over five cycles and determines the amount by which said fuel injection rate should be adjusted so that said averages approaches said optimum value.

* * * * *